US005585215A

United States Patent [19]

Ong et al.

[11] Patent Number: 5,585,215

[45] Date of Patent: Dec. 17, 1996

[54] TONER COMPOSITIONS

[75] Inventors: Beng S. Ong, Mississauga; Walter Mychajlowskij, Georgetown; Raj D. Patel, Oakville, all of Canada

[73] Assignee: Xerox Corporation, Stamford, Conn.

[21] Appl. No.: 663,443

[22] Filed: Jun. 13, 1996

[51] Int. Cl.[6] ..... G03G 9/087

[52] U.S. Cl. ..... 430/107; 430/137

[58] Field of Search ..... 430/106, 114, 430/137, 107

[56] References Cited

U.S. PATENT DOCUMENTS 4,983,488 1/1991 Tan et al. ..... 430/137

4,996,127 2/1991 Hasegawa et al. ..... 430/109

5,366,841 11/1994 Patel et al. ..... 430/137

5,547,804 8/1996 Nishizawa et al. ..... 430/114

*Primary Examiner*—John Goodrow

*Attorney, Agent, or Firm*—E. O. Palazzo

[57] ABSTRACT

A toner comprised of color pigment and an addition polymer resin, and wherein said resin is generated by emulsion polymerization of from 70 to 85 weight percent of styrene, from about 5 to about 20 weight percent of isoprene, from about 1 to about 15 weight percent of acrylate, or from about 1 to about 15 weight percent of methacrylate, and from about 0.5 to about 5 weight percent of acrylic acid.

34 Claims, No Drawings

TONER COMPOSITIONS

PENDING APPLICATIONS

Illustrated in copending application U.S. Ser. No. 633,570 pending, filed concurrently herewith, the disclosure of which is totally incorporated herein by references, is a toner comprised of pigment and a styrene-isoprene-acrylic acid resin, and wherein said resin is obtained by the emulsion polymerization of from about 75 to about 90 weight percent of styrene, from about 5 to about 25 weight percent of isoprene, and from about 0.5 to about 5 percent of acrylic acid.

BACKGROUND OF THE INVENTION

The present invention is generally directed to toner compositions, developers thereof, and toner preparative processes, and more specifically, to a preparative process which involves aggregation of latex, colorant, and additive particles into toner sized aggregates, followed by coalescence or fusion of the latex particles within the aggregates to form integral toner particles to provide toner compositions. In embodiments, the present invention is directed to a chemical in situ preparative process for toners without the need to utilize conventional pulverization and classification methods, thus rendering the present process economical and wherein toner compositions with a particle size as herein defined by volume average diameter of from about 1 to about 20, and preferably from 2 to about 10 microns, and narrow particle size distribution as conventionally characterized by GSD (geometric standard deviation) of, for example, from about 1.10 to about 1.35, and more specifically, from about 1.15 to about 1.25 as measured on the Coulter Counter can be obtained. The resulting toners can be selected for known electrophotographic imaging and printing processes. In embodiments, the present invention is directed to toners based on addition polymer resins derived from emulsion polymerization of a mixture of styrene, isoprene, acrylate or methacrylate, and acrylic acid monomers, and a preparative process thereof comprised of blending by high shearing device a latex emulsion stabilized with an ionic surfactant, and an optional nonionic surfactant with an aqueous pigment dispersion containing an oppositely charged ionic surfactant and optional charge control additive, and other known toner additives. The volume average diameter of the latex particles suitable for the process of the present invention is from about 0.01 micron to about 1.0 micron, and preferably from about 0.05 to about 0.5 micron, while the amount of each ionic surfactant ranges from about 0.01 percent to about 10 percent by weight of the total amount of the reaction mixture. The mixing of the two oppositely charged surfactants induces flocculation of latex, pigment, surfactants, and optional additive particles, which flocculent mixture, on heating with gentle mechanical stirring at a temperature range of from about 25° C. below to about 1 ° C. below the glass transition temperature (Tg) of the latex resin enables the formation of electrostatically bound toner sized aggregates comprised of latex, pigment, and optional additive particles. The size of the aggregates is primarily dependent on the temperature at which aggregation is carried out, and for a given latex composition, larger aggregates are obtained at higher temperatures, provided that the temperature is not above the Tg of the resin so as to cause fusion or coalescence of the latex particles. The particle size distribution of the aggregates does not appear to be dependent on the aggregation temperature, and is generally narrow as typified by a GSD of less than 1.35, and more specifically, of less than about 1.25. These aggregates, which have a volume average diameter of from about 1 to about 20 microns, are then subjected to further heating in the presence of additional anionic surfactant at a temperature above the Tg of the latex resin, and more specifically, at a temperature ranging from about 10° C. to 50° C. above the Tg for a duration of 30 minutes to a few hours to effect fusion or coalescence of the latex particles within the aggregates to form integral toner particles. The degree of coalescence is dependent on the temperature and duration of the heating. Suitable temperatures for coalescence range, for example, from slightly above the Tg to over 100° C., depending on the nature of the latex resin, its composition, the pigment and optional additives. In general, the coalescence is conducted at a temperature of between about 65° C. to about 110° C., and preferably between about 75° C. to about 105° C. The resulting toner particles retain the size of the precursor aggregates, that is the volume average particle size of the aggregates is substantially preserved during coalescence wherein electrostatically bound aggregates are converted to integral toner particles as a result of the fusion of the latex particles within the aggregates. In another embodiment thereof, the present invention is directed to an economical chemical process comprised of first blending by high shear mixing an aqueous pigment dispersion containing a pigment, such as HELIOGEN BLUE™ or HOSTAPERM PINK™, and a cationic surfactant, such as benzalkonium chloride (SANIZOL B-50™), with a latex emulsion comprised of suspended relatively low molecular weight latex resin particles derived from emulsion polymerization of styrene, isoprene, acrylate or methacrylate, and acrylic acid monomers. The latex emulsion is generally stabilized with an anionic surfactant, such as sodium dodecylbenzene sulfonate, for example NEOGEN R™ or NEOGEN SC™, and a nonionic surfactant, such as alkyl phenoxy poly(ethylenoxy)ethanol, for example IGEPAL 897™ or ANTAROX 897™. The latex size ranges from, for example, about 0.01 to about 1.0 micron in volume average diameter as measured by the Brookhaven Nanosizer. The mixing of the two dispersions with two oppositely charged surfactants induces flocculation of the latex, pigment, optional additive particles and surfactants, which flocculent mixture on heating at a temperature of from about 25° C. to about 1° C. below the Tg of the latex resin results in the formation of electrostatically bound aggregates ranging in size from about 2 microns to about 10 microns in volume average diameter as measured by the Coulter Counter. On subsequent heating at about 10° C. to about 50° C. above the Tg of the resin in the presence of additional anionic surfactant, the aggregates are converted into integral toner particles. The aforementioned toners are especially useful for the development of colored images with excellent image resolution, color fidelity, and image projection efficiency.

While not being desired to be limited by theory, it is believed that the aggregation is caused by the attraction between or neutralization of two oppositely charged surfactants, one absorbed on the pigment and optional additive particles, and the other on the latex particles. The aggregation process is temperature dependent, and is faster at higher temperatures. Subsequent heating of the aggregates at a temperature of, for example, 10° C. to 50° C. above the latex resin Tg fuses or coalesces the latex particles within the aggregates, enabling the formation of integral toner particles comprised of polymer resin, pigment particles, and optionally charge control agents. Furthermore, in other embodiments the ionic surfactants on the pigment and latex particles can be interchanged, such that the pigment dispersion contains an anionic surfactant, while the latex emulsion contains a cationic surfactant. It is of importance in the processes of the present invention in embodiments that proper temperature control be exercised as the temperature affects both the aggregate size during aggregation, and the shape and surface morphology of the resulting toner particles during coalescence or fusion. Similarly, to obtain toners of the present invention with the required performance characteristics, critical selection of certain latex compositions derived from emulsion polymerization of styrene, isoprene, acrylate or methacrylate, and acrylic acid monomers is mandatory.

In U.S. Pat. No. 5,366,841, the disclosure of which is totally incorporated herein by reference, there are illustrated emulsion/aggregation processes, and more specifically, a process for the preparation of toner compositions comprising:

(i) preparing a pigment dispersion in water, which dispersion is comprised of a pigment, an ionic surfactant and optionally a charge control agent;

(ii) shearing the pigment dispersion with a latex blend comprised of resin particles, an ionic surfactant of opposite charge polarity to that of said ionic surfactant in the pigment dispersion and a nonionic surfactant thereby causing a flocculation of resin, pigment, and charge control additive particles to form a uniform dispersion of solids in the water, and surfactant;

(iii) heating the above sheared blend at a critical temperature region about equal to or above the glass transition temperature (Tg) of the resin, while continuously stirring to form electrostatically bounded toner size aggregates with a narrow particle size distribution, and wherein said critical temperature is from about 0° C. to about 10° C. above the resin Tg, and wherein the resin Tg is from about 30° C. to about 65° C. and preferably in the range of from about 45° C. to about 65° C.;

(iv) heating the statically bound aggregated particles from about 10° C. to about 45° C. above the Tg of the resin particles to provide a toner composition comprised of polymeric resin, pigment and optionally a charge control agent; and (v) optionally separating and drying said toner.

As examples of resins, in the U.S. Pat. No. 5,366,871 patent is indicated that there may be selected polymers selected from the group consisting of poly(styrene-butadiene), poly(para-methyl styrene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); terpolymers, such as poly(styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, and the like. With the present invention, there are provided toners based on certain styrene-isoprene-acrylate-acrylic acid or styrene-isoprene-methacrylate-acrylic acid resin derived from 70 to 85 weight percent of styrene, 5 to 20 weight percent of isoprene, 1 to 15 weight percent of acrylate or methacrylate, and 0.5 to 5 weight percent of acrylic acid; the weight average molecular weight ($M_w$) of the resin relative to the styrene standards is from about 20,000 to about 40,000 while the number average molecular weight ($M_n$) is from about 5,000 to about 10,000. Advantages achievable with the toners of the present invention include, for example, lower toner fusing temperatures of from about 135° C. to about 170° C., enhanced image resolution from narrow toner particle size distribution, low or no image background noise from narrow toner triboelectric charge distribution and lesser extent of out-of-specification fine particles, high image gloss and excellent image fix characteristics enabled by the relatively low molecular weight resin of specific compositions derived from emulsion polymerization of styrene, isoprene, acrylate or methacrylate, and acrylic acid monomers in embodiments of the present invention. All these attributes have contributed to the attainment of high image quality.

There is illustrated in U.S. Pat. No. 4,996,127 a toner of associated particles of secondary particles comprising primary particles of a polymer having acidic or basic polar groups, and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, in column 9, lines 50 to 55, it is indicated that a polar monomer, such as acrylic acid, in the emulsion resin is necessary, and toner preparation is not obtained without the use, for example, of acrylic acid polar group, see Comparative Example I. Additionally, the process of the '127 patent does not appear to utilize counterionic surfactant and flocculation process as does the present invention, and does not use a counterionic surfactant for dispersing the pigment. In U.S. Pat. No. 4,983,488, there is illustrated a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 are obtained. This process is thus directed to the use of coagulants, such as inorganic magnesium sulfate, which results in the formation of particles with wide GSD. In U.S. Pat. No. 4,797,339, there is disclosed a process for the preparation of toners by resin emulsion polymerization, wherein similar to the '127 patent polar resins of opposite charges are selected, and wherein flocculation, as in the present invention, is not disclosed; and in U.S. Pat. No. 4,558,108, there is disclosed a process for the preparation of a copolymer of styrene and butadiene by specific suspension polymerization. Other prior art that may be of interest includes U.S. Pat. Nos. 3,674,736; 4,137,188 and 5,066,560.

The process described in the present application has several advantages as indicated herein including the effective preparation of small toner particles with narrow particle size distribution without the need to utilize conventional classification processes; the process is very energy efficient as it is a wet process and does not involve energy intensive grinding or pulverization, and classification processes, high process and materials yields, short or reduced process times, and shorter or reduced change over time for preparing different color toners, therefore rendering it attractive and economical. The process of the present invention is particularly efficient for generating particle size below 10 microns, or more specifically, below 8 microns, which is in the regime where conventional pulverization methods become very cost ineffective.

SUMMARY OF THE INVENTION

Examples of objects of the present invention in embodiments thereof include:

It is an object of the present invention to provide toner compositions and processes with many of the advantages illustrated herein.

Another important object of the present invention resides in the provision of toners containing certain styrene-isoprene-acrylate-acrylic acid or styrene-isoprene-methacrylate-acrylic acid resins, and which toners provide high image gloss and excellent image fix at low fusing temperatures.

In another object of the present invention there are provided simple and economical processes for the direct preparation of black and colored toner compositions with, for example, excellent pigment dispersion to enable high image color fidelity and excellent image projection efficiency.

In another object of the present invention there are provided simple and economical chemical processes for black and colored toner compositions comprised of an aggregation step in which the latex, pigment and additive particles aggregate to form electrostatically bound toner sized aggregates, followed by a coalescence step in which the latex particles within the aggregates coalesce and fuse together to form integral toner particles of the present invention.

In a further object of the present invention there is provided a process for the preparation of toner particles with a volume average diameter of from between about 2 to about 10 microns, and with a narrow GSD of from about 1.10 to about 1.35 without the need for size classification.

In a further object of the present invention there is provided a chemical process for the preparation of toner compositions by aggregation and coalescence of latex, pigment and optional additive particles, with the resultant toner particle size being precisely achieved through proper control of the temperature at which aggregation is carried out, and which temperature is generally in the range of from about 25° C. to about 65° C.

In yet another object of the present invention there are provided toner compositions with lower fusing temperature characteristics of about 5° C. to about 30° C. lower than those of conventional styrene-based toners.

In another object of the present invention there are provided toner compositions which provide high image projection efficiency of, for example, from over 65 to about 95 percent as measured by the Match Scan II spectrophotometer available from Milton-Roy.

In a further object of the present invention there are provided toner compositions which, when properly fused on paper substrate, afford minimal or no paper curl.

These and other objects of the present invention are accomplished in embodiments by the provision of toners and processes thereof. In embodiments of the present invention, there are provided toners and processes for the economical preparation of toner compositions by aggregation of latex, pigment and additive particles, followed by coalescence or fusion of latex particles with the aggregates to give integral toner particles, and wherein the aggregation is conducted at a temperature of from about 25° C. below to about 1° C. below the Tg of the latex resin, while the coalescence is accomplished at a temperature that is about 10° C. to about 55° C. above the Tg temperature.

The toners of the present invention preferably include as the resin an addition polymer derived from emulsion polymerization of about 70 to about 85 weight percent of styrene, about 5 to about 20 weight percent of isoprene, about 1 to about 15 weight percent of acrylate or methacrylate, and about 0.5 to about 5 weight percent of acrylic acid monomers, and wherein the resin has an $M_w$ of from about 20,000 to about 35,000, and an $M_n$ of from about 5,000 to about 10,000.

Embodiments of the present invention include a toner comprised of color pigment and an addition polymer resin, and wherein said resin is generated by emulsion polymerization of from about 70 to about 85 weight percent of styrene, from about 5 to about 20 weight percent of isoprene, from about 1 to about 15 weight percent of acrylate, or from about 1 to about 15 weight percent of methacrylate, and from about 0.5 to about 5 weight percent of acrylic acid; a toner comprised of pigment and a styrene-isoprene-acrylate-acrylic acid resin or styrene-isoprene-methacrylate-acrylic acid resin, and wherein said resin is generated by the emulsion polymerization of from about 75 to about 85 weight percent of styrene, about 5 to about 15 weight percent of isoprene, about 1 to about 15 weight percent of acrylate or about 1 to about 15 weight percent of methacrylate, and about 0.5 to about 3 weight percent of acrylic acid, and wherein said resin possesses a weight average molecular weight ($M_w$) of from about 20,000 to about 35,000 and a number average molecular weight ($M_n$) of from about 6,000 to about 10,000 relative to the styrene standard; and a process for the preparation of toner compositions comprising:

(i) preparing a pigment dispersion in water, which dispersion is comprised of a pigment, an ionic surfactant and optionally a charge control agent;

(ii) shearing the pigment dispersion with a latex emulsion derived from a mixture of styrene, isoprene, acrylate or methacrylate, and acrylic acid, and wherein said resin is generated by the emulsion polymerization of from about 75 to about 85 weight percent of styrene, about 5 to about 15 weight percent of isoprene, about 1 to about 15 weight percent of acrylate or about 1 to about 15 weight percent of methacrylate, and about 0.5 to about 3 weight percent of acrylic acid, and wherein said resin possesses a weight average molecular weight ($M_w$) of from about 20,000 to about 35,000 and a number average molecular weight ($M_n$) of from about 6,000 to about 10,000 relative to a styrene standard, and said resin is stabilized with an optional nonionic surfactant and an ionic surfactant having an opposite charge polarity to that of said ionic surfactant in the pigment dispersion, thereby causing a flocculation of the resin, pigment, surfactants, and optional charge control additive particles;

(iii) heating the above flocculent mixture while stirring at a temperature of from about 25° C. below to about 1° C. below the glass transition temperature (Tg) of the resin to effect formation of electrostatically bounded toner sized aggregates with a narrow aggregate size distribution, and wherein the resin has a Tg of from about 45° C. to about65° C.;

(iv) heating the aggregates from about 10° C. to about 55° C. above the Tg of the resin to form toner particles comprised of said polymeric resin, pigment and optionally a charge control agent; and (v) optionally separating and drying said toner.

In embodiments, the present invention is directed to processes for the preparation of toner compositions, which comprises initially preparing an ionic pigment dispersion, for example by homogenizing an aqueous mixture of a pigment or pigments, such as carbon black like REGAL 330®, phthalocyanine, quinacridone or RHODAMINE B™ type with a cationic surfactant, such as benzalkonium chloride, by means of a high shearing device, such as a Brinkman Polytron, thereafter blending this mixture using a high shear device, such as a polytron, a sonicator or microfluidizer, with a latex emulsion comprised of styrene-isoprene-acrylic acid resin particles stabilized with an anionic surfactant, such as sodium dodecylbenzene sulfonate and optional nonionic surfactants, and wherein the latex size ranges from about 0.01 to about 1.0 micron, thereby giving rise to flocculation of latex particles with the pigment particles; heating the mixture at a temperature of preferably from 25° C. below to 10° C. above the Tg of the latex resin while being mechanically stirred at about 200 to about 500 rpm to effect formation of electrostatically bound aggregates with an average aggregate size ranging from about 1 to 20 microns, and preferably from about 3 to 10 microns; followed by coalescing the resultant aggregates to integral toner particles at a temperature of preferably from about 10° C. to about 50° C. above the Tg of the latex resin; and subsequently washing the toner with water; and drying by means of, for example, freeze dryer, fluidized bed dryer, or spray dryer to afford toner compositions comprised of styrene-isoprene-acrylic acid resin, pigment and optional additives with toner size of preferably from 3 to 10 microns in volume average diameter.

Embodiments of the present invention include a process for the preparation of toner compositions comprised of pigment, optional additives, and certain critical resins derived from emulsion polymerization of a mixture of styrene, isoprene, acrylate or methacrylate, and acrylic acid monomers, comprising (i) preparing a pigment dispersion in water, which dispersion is comprised of a pigment, an ionic surfactant and optionally a charge control agent;

(ii) blending by high shear mixing the pigment dispersion with a latex emulsion derived from a mixture of styrene, isoprene, acrylate or methacrylate, and acrylic acid monomers stabilized with an optional nonionic surfactant and an ionic surfactant that is of opposite polarity to that in the pigment dispersion;

(iii) heating the resultant homogenized mixture at a temperature of preferably from 25° C. below to 1° C. below the Tg temperature of the latex resin, thereby inducing aggregation of latex, pigment and optional additive particles to form electrostatically bound toner sized aggregates; followed by (iv) coalescing the aggregates to form integral toner particles by heating at a temperature of about 10° C. to about 55° C. above the Tg temperature of the latex resin.

Also, in embodiments the present invention is directed to processes for the preparation of toner compositions which comprises (i) preparing a pigment mixture by dispersing a pigment, such as carbon black like REGAL 330®, HOSTAPERM PINK™, or PV FAST BLUE™ of from about 1 to about 20 percent by weight of toner in an aqueous mixture containing a cationic surfactant, such as dialkylbenzene dialkylammonium chloride, for example SANIZOL B-50™ available from Kao, or MIRAPOL™ available from Alkaril Chemicals, utilizing a high shearing device, such as a Brinkman Polytron or IKA homogenizer for a duration of from about 1 minute to about 120 minutes; (ii) adding the aforementioned cationic pigment dispersion to a latex emulsion derived from emulsion polymerization of styrene, isoprene, acrylate or methacrylate, and acrylic acid stabilized with an anionic surfactant like sodium dodecylsulfate, dodecylbenzene sulfonate or NEOGEN R™ and a nonionic surfactant, such as polyethylene glycol or polyoxyethylene glycol nonyl phenyl ether or IGEPAL 897™ obtained from GAF Chemical Company, thereby causing a flocculation of latex, pigment, charge control additive particles; (iii) homogenizing the flocculent mixture using a high shearing device, such as a Brinkman Polytron or IKA homogenizer, at a speed of from about 3,000 revolutions per minute to about 10,000 revolutions per minute for a duration of from about 1 minute to about 120 minutes, and heating the resultant mixture at a temperature of from 25° C. below to 1° C. below the Tg of the latex resin while mechanically stirred at a speed of from about 250 to about 500 rpm to effect formation of electrostatically bound aggregates of from about 2 microns to about 10 microns in volume average diameter; (iv) subsequently heating the aggregate mixture at 65° C. to about 110° C. for a duration of about 30 minutes to a few hours in the presence of additional anionic surfactant in the amount of from about 0.01 percent to about 5 percent by weight to form integral toner particles of from about 2 microns to about 10 microns in volume average diameter and a GSD of from about 1.15 to about 1.30 as measured by the Coulter Counter; and (v) isolating the toner particles by washing, filtering and drying thereby providing toner particles with a styrene-isoprene-acrylate-acrylic acid resin or styrene-isoprene-methacrylate-acrylic acid resin and pigment. Flow additives to improve flow properties and charge additives to improve charging characteristics may be optionally added by blending with the above mentioned toner, such additives include AEROSILS® or silicas, metal oxides like tin, titanium and the like, metal salts of fatty acids like zinc stearate, and which additives can be present in various effective amounts, such as from about 0.1 to about 10 percent by weight of toner.

The aforementioned latex resins selected for the process of the present invention are present in various effective amounts, such as from about 70 to about 98, and preferably from about 80 weight percent to about 98 weight percent of the toner, and the latex particle size can be in embodiments of from about 0.01 micron to about 1 micron in volume average diameter as measured by the Brookhaven Nanosizer particle analyzer.

Illustrative examples of the acrylate and methacrylate monomers utilized in the emulsion polymerization for the preparation of latex resin for the toner compositions of the present invention include methyl acrylate, ethyl acrylate, propyl acrylate, butyl acrylate, pentyl acrylate, hexyl acrylate, methyl methacrylate, ethyl methacrylate, propyl methacrylate, butyl methacrylate, and the like, including other alkyl acrylates.

Various known colorants or pigments present in the toner in an effective amount of, for example, from about 1 to about 20 percent by weight of the toner, and preferably in an amount of from about 3 to about 15 weight percent, that can be selected include carbon black, like REGAL 330®, REGAL 660®, REGAL 400®, REGAL 400 R®, and REGAL 330R®, REGAL 660R® and other equivalent black pigments. As colored pigments, there can be selected known cyan, magenta, red, green, blue, brown, yellow, or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAperm YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference; nitrobenzene sulfonates; TRH, a known charge enhancing additive aluminum complex, BONTRON E-84™ and E-88™, available from Orient Chemicals of Japan, and other known charge enhancing additives, and the like. Mixtures of charge additives may also be selected.

Examples of anionic surfactants employed in the emulsion polymerization for the preparation of latex resin for the toner compositions of the present invention include, for example, sodium dodecylsulfate, sodium dodecylbenzene sulfonate, sodium dodecylnaphthalene sulfate, dialkyl benzenealkyl, sulfates and sulfonates, abetic acid, available from Aldrich, NEOGEN R™, NEOGEN SC™ obtained from Kao and the like. An effective concentration of the anionic surfactant is, for example, from about 0.01 to about 10 percent by weight, and preferably from about 0.1 to about 5 percent by weight of the latex resin.

Illustrative examples of nonionic surfactants in amounts of, for example, from about 0.01 to about 10 percent by weight, and preferably from about 0.1 to about 5 percent by weight of latex resin in embodiments, include dialkylphenoxypoly(ethyleneoxy) ethanol available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™.

Examples of cationic surfactants utilized in the pigment dispersion for the toners and processes of the present invention include, for example, dialkyl benzenealkyl ammonium chloride, lauryl trimethyl ammonium chloride, alkyl benzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride) available from Kao Chemicals, and the like, and mixtures thereof. This surfactant is utilized in various effective amounts, such as for example from about 0.01 to about 10 percent by weight of latex resin. Generally, the molar ratio of the cationic surfactant in the pigment dispersion to the anionic surfactant utilized in the latex preparation is in the range of from about 0.05 to about 4, and preferably from 0.05 to 2.

Examples of the additional surfactants, which are added just before the coalescence step to prevent further growth in aggregate size with increasing temperature, include anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao and the like, and nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the surfactant that serves to stabilize the aggregate size during coalescence ranges, for example, from about 0.01 to about 10 percent by weight, and preferably from about 0.05 to about 5 percent by weight of the total weight of reaction mixture.

Surface additives that can be added to the toner compositions after washing and drying include, for example, those mentioned herein, such as metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent, which can also be added during the aggregation or coalescence process, the washing step or the dry blending step wherein additives are mechanically coated onto the surface of the toner product.

Developer compositions can be prepared by blending the toners obtained with the processes of the present invention with known carrier particles, including coated carriers, such as steel, iron, ferrites, and the like, reference U.S. Pat. Nos. 4,937,166 and 4,935,326, the disclosures of which are totally incorporated herein by reference, for example from about 2 percent toner concentration to about 8 percent toner concentration.

The following Examples are being submitted to further define the various aspects of the present invention. These Examples are intended to be illustrative only and are not intended to limit the scope of the present invention. Comparative Examples are also provided.

EXAMPLE I

A mixture of 49.0 grams of styrene, 60.0 grams of isoprene, 48.0 grams of butyl acrylate, 12.0 grams of acrylic acid, and 18.0 grams of dodecanethiol was mechanically emulsified in 935.0 grams of aqueous solution of 13.5 grams of sodium dodecyl benzene sulfonate (SDBS) anionic surfactant (NEOGEN R™ which contains 60 percent of active SDBS and 40 percent of water component), 12.9 grams of polyoxyethylene nonyl phenyl ether nonionic surfactant (ANTAROX 897™, 70 percent active, polyethoxylated alkylphenols), and 6.0 grams of ammonium persulfate initiator at room temperature for 25 minutes. The emulsion was then heated with mechanical stirring at 70° C. for 6 hours to produce a latex emulsion containing 40 percent by weight of a latex polymer of styrene, isoprene, butyl acrylate, and acrylic acid monomers. The latex polymer evidenced a particle size of 120 nanometers, as measured on Brookhaven Nanosizer, and possessed a Tg of 54.5° C. (mid-point), as measured on a DuPont DSC, an $M_w$ of 22,000, and an $M_n$ of 8,400 as determined on a Hewlett Packard GPC.

260.0 Grams of the above latex emulsion and 230.0 grams of an aqueous mixture containing 7.5 grams of dispersed BHD 6000 Sunsperse Cyan Pigment (54.4 weight percent of pigment) obtained from Sun Chemicals, and 2.6 grams of cationic surfactant, SANIZOL B™, were simultaneously added to 400 grams of water with high shear stirring by means of a polytron. Subsequently, the mixture was transferred to a 2 liter reaction vessel and heated at 50° C. for 95 minutes to effect formation of toner sized aggregates with a volume average aggregate size of 6.2 microns and a GSD of 1.18. After addition of 15.0 milliliters of 20 percent aqueous anionic surfactant (NEOGEN R™) solution, the aggregate suspension was heated to a temperature of 95° C. and held there for a period of 3 hours. The particle size of the resulting toner product was 6.6 microns with a GSD of 1.20.

Standard fusing properties of the toner compositions of the present invention were evaluated as follows: unfused images of toner on paper with a controlled toner mass per unit area of 1.2 milligrams/$cm^2$ were produced by one of a number of methods. A suitable electrophotographic developer was produced by mixing from 2 to 10 percent by weight of the toner with a suitable electrophotographic carrier, such as, for example, a 90 micron diameter ferrite core, spray coated with 0.5 weight percent of a terpolymer of poly(methyl methacrylate), styrene, and vinyltriethoxysilane, and roll milling the mixture for 10 to 30 minutes to produce a tribocharge of between −5 to −20 microcoulombs per gram of toner as measured by the Faraday Cage. The developer was introduced into a small electrophotographic copier, such as Mita DC-111, in which the fuser system had been disconnected. Between 20 and 50 unfused images of a test pattern consisting of a 65 millimeter by 65 millimeter square solid area were produced on 8½ by 11 inch sheets of a typical electrophotographic paper such as Xerox Corporation Image LX© paper.

The unfused images were then fused by feeding them through a hot roll fuser consisting of a fuser roll and pressure roll with elastomer surfaces, both of which are heated to a controlled temperature. Fused images were produced over a range of hot roll fusing temperatures from about 130° C. to about 210° C. The gloss of the fused images was measured according to TAPPI Standard T480 at a 75° angle of incidence and reflection using a Novo-Gloss© Statistical Glossmeter, Model GL-NG 1002S from Paul N. Gardner Company, Inc. The degree of permanence of the fused images was evaluated by the Crease Test (crease test data can be expressed as MFT). The fused image was folded under a specific weight with the toner image to the inside of the fold. The image was then unfolded and any loose toner wiped from the resulting Crease with a cotton swab. The average width of the paper substrate, which shows through the fused toner image in the vicinity of the Crease, was measured with a custom built image analysis system.

The fusing performance of a toner is traditionally judged from the fusing temperatures required to achieve acceptable image gloss and fix. For high quality color applications, an image gloss greater than 50 gloss units is preferred. The minimum fuser temperature required to produce a gloss of 50 is defined as $T(G_{50})$ for a given toner. Similarly, the minimum fuser temperature required to produce a Crease value less than the maximum acceptable Crease is known as the Minimum Fix Temperature (MFT) for a given toner. In general, it is desirable to have both $T(G_{50})$ and MFT as low as possible, such as for example below 190° C., and preferably below 170° C., in order to minimize the power requirements of the hot roll fuser.

Fusing evaluation showed that the toner of this Example had a $T(G_{50})$ of 136° C. and an MFT of 144° C.

EXAMPLE II

A latex emulsion was prepared in accordance with the procedure of Example I with the exception that 72.0 grams of isoprene and 36.0 grams of butyl acrylate were utilized in place of 60.0 grams of isoprene and 48.0 grams of butyl acrylate. The resulting latex emulsion showed a latex size of 125 nanometers, a Tg of 56.5° C. (mid-point), an $M_w$ of 30,500, and an $M_n$ of 8,900.

A toner was prepared with the above latex emulsion in accordance with the procedure of Example I except that the aggregation reaction was conducted at 50° C. for 50 minutes to produce 6.4 micron sized aggregates with a GSD of 1.17. The coalescence step was performed at 95° C. for 5 hours to give a toner product with a particle size of 6.8 microns and a GSD of 1.21. Fusing evaluation indicated that the toner of this Example had a $T(G_{50})$ of 135° C. and an MFT of 142° C.

EXAMPLE III

A latex emulsion was prepared in accordance with the procedure of Example I except that 504.0 grams of styrene, and 36.0 grams of butyl acrylate were utilized in place of 492.0 grams of styrene and 48.0 grams of butyl acrylate. The latex particle was measured to be 130 nanometers, and the latex polymer had a Tg of 58.5° C. (mid-point), an $M_w$ of 23,800, and an $M_n$ of 8,400.

A toner was prepared with the above latex emulsion in accordance with the Example I except that the aggregation reaction was conducted at 53° C. for 80 minutes to produce 6.1 micron aggregates with a GSD of 1.19. The subsequent coalescence step was performed at 95° C. for a period of 6 hours to give a toner product having a particle size of 6.6 microns and a GSD of 1.21. Fusing evaluation indicated that the toner of this Example had a $T(G_{50})$ of 139° C. and an MFT of 147° C.

EXAMPLE IV

A latex emulsion was prepared in accordance with the procedure of Example I except that 84.0 grams of isoprene and 24 grams of butyl acrylate were used instead of 60.0 grams of isoprene and 48.0 grams of butyl acrylate. The latex emulsion showed a latex size of 120 nanometers, and the polymer possessed a Tg of 49.5° C. (mid-point), an $M_w$ of 28,500, and an $M_n$ of 8,800. A toner was prepared from this latex emulsion as above except that the aggregation reaction was conducted at 48° C. for 80 minutes to give an aggregate size of 8.1 microns and a GSD of 1.17. The subsequent coalescence was performed at 95° C. for a period of 5 hours. The toner size was measured to be 8.3 microns with a GSD of 1.20. Fusing evaluation indicated that the toner of this Example had a $T(G_{50})$ of 134° C. and an MFT of 140° C.

EXAMPLE V

A latex emulsion was prepared as before with the exception that 36.0 grams of isoprene and 72.0 grams of butyl acrylate were used instead of 60.0 grams of isoprene and 48.0 grams of butyl acrylate. The latex size was measured to be 125 nanometers, and the polymer had a Tg of 57° C. (mid-point), an $M_w$ of 22,700, and an $M_n$ of 9,500.

A toner was prepared from the above latex emulsion as before except that the aggregation reaction was conducted at 52° C. for 2 hours to give an aggregate size of 6.8 microns and a GSD of 1.19. The subsequent coalescence was performed at 95° C. for a period of 7 hours, affording a toner product with a particle size of 7.1 microns and a GSD of 1.21. Fusing evaluation indicated that the toner of this Example had a $T(G_{50})$ of 138° C. and an MFT of 148° C.

Other embodiments and modifications of the present invention may occur to those skilled in the art subsequent to a review of the information presented herein; these embodiments and modifications, as well as equivalents thereof, are also included within the scope of the present invention.

What is claimed is:

1. A dry toner consisting essentially of pigment and an addition polymer resin, and wherein said resin is generated by emulsion polymerization of from about 70 to about 85 weight percent of styrene, from about 5 to about 20 weight percent of isoprene, from about 1 to about 15 weight percent of acrylate, or from about 1 to about 15 weight percent of methacrylate, and from about 0.5 to about 5 weight percent of acrylic acid, and wherein said emulsion polymerization consists essentially of shearing a pigment dispersion with a latent emulsion containing said addition polymer resin, heating the resulting mixture below about the glass transition temperature of said addition polymer resin, and thereafter, heating above about addition polymer resin glass transition temperature, and optionally separating and drying said toner.

2. A dry toner consisting essentially of pigment and a styrene-isoprene-acrylate-acrylic acid resin or styrene-isoprene-methacrylate-acrylic acid resin, and wherein said resin is generated by the emulsion polymerization of from about 75 to about 85 weight percent of styrene, about 5 to about 15 weight percent of isoprene, about 1 to about 15 weight percent of acrylate or about 1 to about 15 weight percent of methacrylate, and about 0.5 to about 3 weight percent of acrylic acid, and wherein said resin possesses a weight average molecular weight ($M_w$) of from about 20,000 to about 35,000 and a number average molecular weight ($M_n$) of from about 6,000 to about 10,000 relative to a styrene standard, and wherein said emulsion polymerization consists essentially of shearing a pigment dispersion with a latex emulsion containing an ionic surfactant having an opposite charge polarity to that of said ionic surfactant in the pigment dispersion wherein the pigment dispersion consists essentially of a pigment and an ionic surfactant, and wherein said addition polymer resin in the emulsion contains from about 75 to about 85 weight percent of styrene, about 5 to about 15 weight percent of isoprene, about 1 to about 15 weight percent of acrylate, or about 1 to about 15 weight percent of methacrylate, and about 0.5 to about 3 weight percent of acrylic acid, and wherein said resin possesses a weight average molecular weight ($M_w$) of from about 20,000 to about 35,000and a number average molecular weight ($M_n$) of from about 6,000 to about 10,000, relative to a styrene standard, and said resin is stabilized with an optional nonionic surfactant causing a flocculation of the resin, pigment, and surfactants; by heating with stirring at a temperature of from about 25° C. below to about 1° C. below the glass transition temperature (Tg) of the resin to effect formation of toner sized aggregates, and wherein the resin has a Tg of from about 45° C. to about 65° C.; heating the aggregates from about 10° C. to about 55° C. above the Tg of the resin to form toner particles comprised of said polymeric resin, pigment and optionally a charge control agent; and optionally separating and drying said toner.

3. A toner in accordance with claim 2 wherein the resin possesses an $M_w$ of from about 25,000 to about 30,000, and an $M_n$ of from about 6,000 to about 10,000 relative to a styrene standard.

4. A toner in accordance with claim 2 wherein the resin is obtained from emulsion polymerization of 75 to 85 weight percent of styrene, 5 to 15 weight percent of isoprene, 1 to 10 weight percent of acrylate or methacrylate, and 0.5 to 2 weight percent of acrylic acid.

5. A toner in accordance with claim 2 wherein the resin has an $M_w$ of about 26,000 and an $M_n$ of about 7,000 relative to styrene standards.

6. A toner in accordance with claim 2 wherein the acrylate is selected from the group consisting of methyl acrylate, ethyl acrylate, propyl acrylate, butyl acrylate, pentyl acrylate, and hexyl acrylate.

7. A toner in accordance with claim 2 wherein the methacrylate is selected from the group consisting of methyl methacrylate, ethyl methacrylate, propyl methacrylate, and butyl methacrylate.

8. A toner in accordance with claim 2 wherein the toner provides excellent image fix at a fusing temperature of from about 135° C. to about 170° C.

9. A toner in accordance with claim 2 wherein the toner provides excellent image fix at a fusing temperature of from about 145° C.

10. A toner in accordance with claim 3 wherein the toner provides excellent image fix at a fusing temperature of from about 135° C. to about 170° C.

11. A toner in accordance with claim 3 wherein the toner provides excellent image fix at a fusing temperature of from about 145° C.

12. A toner in accordance with claim 2 wherein the gloss 50, $G_{50}$ temperature thereof is from about 135° C. to about 170° C.

13. A toner in accordance with claim 3 wherein the gloss 50 temperature thereof is from about 135° C. to about 170° C.

14. A toner in accordance with claim 2 wherein the gloss 50, $G_{50}$ temperature thereof is about 145° C.

15. A toner in accordance with claim 2 wherein the pigment is carbon black.

16. A toner in accordance with claim 2 wherein the pigment is selected from the group consisting of black, cyan, magenta, yellow, blue, green, brown pigments, and mixtures thereof.

17. A toner in accordance with claim 3 wherein the pigment is selected from the group consisting of black, cyan, magenta, yellow, blue, green, brown pigments, and mixtures thereof.

18. A toner in accordance with claim 2 further containing a charge control additive.

19. A toner in accordance with claim 18 wherein the charge control additive is selected from the group consisting of distearyl dimethyl ammonium methyl sulfate, cetyl pyridinium halide, distearyl dimethyl ammonium bisulfate, aluminum salicylate complexes, zinc salicylate complexes, and mixtures thereof.

20. A toner in accordance with claim 2 further containing wax, and surface additives.

21. A developer comprised of the toner of claim 1 and carrier.

22. A developer comprised of the toner of claim 2 and carrier, and wherein the carrier is comprised of a metal core with a polymer coating.

23. A process for the preparation of dry toner compositions consisting essentially of:

(i) preparing a pigment dispersion in water, which dispersion is comprised of a pigment, an ionic surfactant and optionally a charge control agent;

(ii) shearing the pigment dispersion with a latex emulsion derived from a mixture of styrene, isoprene, acrylate or methacrylate, and acrylic acid, and wherein said resin is generated by the emulsion polymerization of from about 75 to about 85 weight percent of styrene, about 5 to about 15 weight percent of isoprene, about 1 to about 15 weight percent of acrylate or about 1 to about 15 weight percent of methacrylate, and about 0.5 to about 3 weight percent of acrylic acid, and wherein said resin possesses a weight average molecular weight ($M_w$) of from about 20,000 to about 35,000 and a number average molecular weight ($M_n$) of from about 6,000 to about 10,000 relative to a styrene standard, and said resin is stabilized with an optional nonionic surfactant and an ionic surfactant having an opposite charge polarity to that of said ionic surfactant in the pigment dispersion, thereby causing a flocculation of the resin, pigment, surfactants, and optional charge control additive particles;

(iii) heating the above flocculent mixture with stirring at a temperature of from about 25° C. below to about 1° C. below the glass transition temperature (Tg) of the resin to effect formation of electrostatically bounded toner sized aggregates with a narrow aggregate size distribution, and wherein the resin has a Tg of from about 45° C. to about 65° C.;

(iv) heating the aggregates from about 10° C. to about 55° C. above the Tg of the resin to form toner particles comprised of said polymeric resin, pigment and optionally a charge control agent; and (v) optionally separating and drying said toner.

24. A process in accordance with claim 23 wherein the aggregate size, and the final toner particle size is from 1 to 20 microns in volume average diameter.

25. A process in accordance with claim 23 wherein the final toner particle size distribution is of a narrow GSD of from about 1.15 to about 1.25.

26. A process in accordance with claim 23 wherein the ionic surfactant utilized in preparing the pigment dispersion is a cationic surfactant, and the ionic surfactant present in the latex emulsion is anionic in nature.

27. A process in accordance with claim 23 wherein the pigment dispersion (i) is accomplished by homogenizing at from about 1,000 revolutions per minute to about 10,000 revolutions per minute, or by microfluidization in a microfluidizer or in nanojet, or by an ultrasonic probe at from about 300 watts to about 900 watts of energy at a temperature of from about 25° C. to about 40° C. for a duration of from about 1 minute to about 120 minutes.

28. A process in accordance with claim 23 wherein the heating of the flocculent mixture of latex, pigment, surfactants and optional charge control agent in (iii) is accomplished at temperatures of from about 10° C. to about 1° C. below the resin Tg for a duration of from about 30 minutes to about 6 hours.

29. A process in accordance with claim 23 wherein the optional nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; and wherein the anionic surfactant is selected from the group consisting of sodium dodecyl sulfate, sodium dodecylbenzene sulfate, and sodium dodecylnaphthalene sulfate.

30. A process in accordance with claim 23 wherein the latex size is from about 0.01 to 1 micron in volume average diameter.

31. A process in accordance with claim 23 wherein the pigment particles are from about 0.01 to about 3 microns in volume average diameter.

32. A toner obtained by the process of claim 23.

33. A toner in accordance with claim 1 wherein from about 1 to about 15 weight percent of acrylate is selected.

34. A toner in accordance with claim 1 wherein from about 1 to about 15 weight percent of methacrylate is selected.

* * * * *